US007836638B2

(12) United States Patent
Ogieglo

(10) Patent No.: US 7,836,638 B2
(45) Date of Patent: Nov. 23, 2010

(54) ATTIC ACCESS

(76) Inventor: Joe Ogieglo, 2415 Jarvis Dr., Saskatoon, SK (CA) S7J 2T8

( * ) Notice: Subject to any disclaimer, the term of this patent is extended or adjusted under 35 U.S.C. 154(b) by 0 days.

(21) Appl. No.: 12/432,857

(22) Filed: Apr. 30, 2009

(65) Prior Publication Data

US 2009/0277099 A1 Nov. 12, 2009

(30) Foreign Application Priority Data

May 6, 2008 (CA) ..... 2639640

(51) Int. Cl.
*E06B 5/00* (2006.01)
*E02D 29/14* (2006.01)

(52) U.S. Cl. ..... 52/19; 52/202; 52/745.15

(58) Field of Classification Search ..... 52/19, 52/202, 211, 745.15
See application file for complete search history.

(56) References Cited

U.S. PATENT DOCUMENTS 2,767,876 A * 10/1956 Mautner ..... 217/65
2,848,761 A * 8/1958 Hahn ..... 52/208
3,164,869 A * 1/1965 Barkan ..... 49/479.1
4,299,059 A * 11/1981 Smith ..... 49/401
4,658,555 A * 4/1987 Steiner ..... 52/202
4,761,920 A * 8/1988 Coulson ..... 52/19
6,578,327 B1 * 6/2003 Hackbarth et al. ..... 52/202
6,701,676 B1 3/2004 Kompelien
6,848,492 B2 * 2/2005 Thomas ..... 160/368.1
7,089,704 B2 * 8/2006 Jejina et al. ..... 52/19
7,650,722 B1 * 1/2010 Melesky ..... 52/199
2003/0121216 A1 * 7/2003 Nale ..... 52/19
2003/0172596 A1 * 9/2003 Talley et al. ..... 52/19
2009/0133342 A1 * 5/2009 Copeland ..... 52/202

* cited by examiner

*Primary Examiner*—Robert J Canfield
(74) *Attorney, Agent, or Firm*—King & Schickli, PLLC

(57) ABSTRACT

An attic access apparatus comprises an access frame with sidewalls extending upward from a flange member and configured to extend upward into an attic opening between structural members forming the attic opening. A recessed groove along inner surfaces of the sidewalls is configured such that fastening screws can be located in the groove. A trim flange extends outward from the sidewall to cover fasteners used to fasten the ceiling to the bottom of the structural members, and a support flange extends inward from the sidewalls to form a support flange. An insulated lid drops into the access opening formed by the inner surfaces of the sidewalls and rests on the support flange, and a seal member provides a seal between the lid and the access frame to prevent air movement between the lid and access frame.

13 Claims, 1 Drawing Sheet

ATTIC ACCESS

This invention is in the field of building construction and in particular provides a preformed and prefinished attic access apparatus for installation in buildings.

BACKGROUND

Attic space is typically provided in building construction between the top of the ceiling structure and the bottom of the roof structure. Although it is typically required to access this attic space only occasionally, access must be provided. Such an attic access apparatus is disclosed for example in U.S. Pat. No. 6,701,676 to Kompelien. The attic access apparatus comprises a housing and an insulated door, and is installed into a hole cut in the ceiling between the ceiling rafters and secured with screws. A flange is then nailed to the bottom side of the rafters and the ceiling with nails and covered with taping compound, texture or trim.

Other conventional attic access apparatuses are known, and these require some trim and finishing, as described by Kompelien, to complete the installation. Where the interior finish is conventional drywall, in order to properly finish the access port, it is typically required to install the attic access apparatus before fastening the drywall boards to the framing members. In typical building construction, a framing crew will install the frame, then various plumbers, electricians, and the like will install the various utilities before the drywall crew installs the drywall boards. In a busy construction site it can happen that the attic access apparatus is missed and not installed especially where the item to be installed does not fall readily into the realm of one of the trades such as electricians or plumbers. Considerable added time and expense must be incurred to install the attic access apparatus and then repair and finish the drywall.

SUMMARY OF THE INVENTION

It is an object of the present invention to provide an attic access apparatus that overcomes problems in the prior art.

The present invention therefore provides an attic access apparatus that is installed anytime after the ceiling surrounding a rough opening to the attic is finished. The apparatus is installed quickly and provides a trimmed and finished access port.

In a first embodiment the present invention provides an attic access apparatus to provide access to an attic through an attic opening in a ceiling. The apparatus comprises an access frame with sidewalls extending upward from a middle portion of a flange member to define an access opening, the sidewalls configured to extend upward into the attic opening between structural members forming the attic opening such that outer surfaces of the sidewalls of the access frame fit in close proximity to the structural members. A recessed groove along inner surfaces of the sidewalls is configured such that fastening screws can be located in the groove so that heads of the screws are in the groove and below inner surfaces of the sidewalls of the access frame. An outward portion of the flange member extends outward from outer surfaces of the sidewall to form a trim flange configured to cover fasteners used to fasten the ceiling to the bottom of the structural members, and an inward portion of the flange member extends inward from the inner surfaces of the sidewalls to form a support flange. An insulated lid is configured to drop into the access opening formed by the inner surfaces of the sidewalls and rest on the support flange, and a seal member is operative to provide a seal between the lid and the access frame to prevent air movement between the lid and access frame.

In a second embodiment the present invention provides a method for providing access to an attic through an attic opening in a ceiling. The method comprises forming an access frame from T-shaped members having a wall extending upward from a middle portion of a flange member, the access frame having sidewalls extending upward from the flange member, the access frame defining an access opening; configuring the access frame such that the sidewalls extend upward into the attic opening between structural members forming the attic opening such that outer surfaces of the sidewalls of the access frame fit in close proximity to the structural member, and such that an outward portion of the flange member extends outward from outer surfaces of the sidewall to form a trim flange configured to cover fasteners used to fasten the ceiling to the bottom of the structural members, and such that an inward portion of the flange member extends inward from the inner surfaces of the sidewalls to form a support flange; providing a recessed groove along inner surfaces of the sidewalls, and driving fasteners through the sidewalls into the structural members such that heads of the fasteners are located in the groove below inner surfaces of the sidewalls of the access frame; providing an insulated lid and dropping the lid into the access opening from above the access frame down into the access opening such that a bottom surface of the lid rests on the support flange; and providing a seal between the lid and the access frame to prevent air movement between the lid and access frame.

A lip is conveniently provided on the top edge of the lid which extends over the top edges of the sidewalls, and is configured so the lip is in close proximity to, or resting on, the top edge of the sidewalls when the bottom of the lid is resting on the support flange. A further seal can be provided on the top edge of the sidewall to seal the lip to the frame.

The bottom surface and edges of the flange member are configured to provide a finished trim, such that the frame can simply be inserted and fastened, and the rough opening to the attic is finished and ready for occupancy. Conveniently the frame is constructed by extruding a plastic piece that includes the grooved sidewalls and flange member, and then the extrusion is simply cut and welded to form the access frame. The bottom surface and exposed edges of the flange member are rounded and smoothed and colored as desired to provide the desired finished appearance.

Similarly the bottom surface of the lid is provided by a prefinished panel of the desired color. It is contemplated that the most common color for the lid and flange member will be some shade of white however other colors may also prove to be popular.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
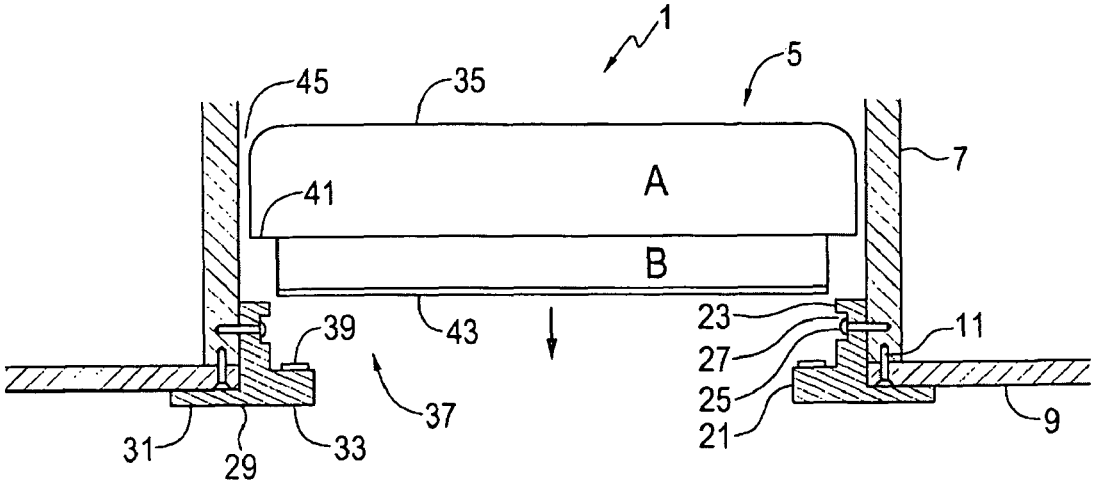
FIG. 1 is a schematic sectional side view of an embodiment of an attic access apparatus of the present invention.
Figure 2:
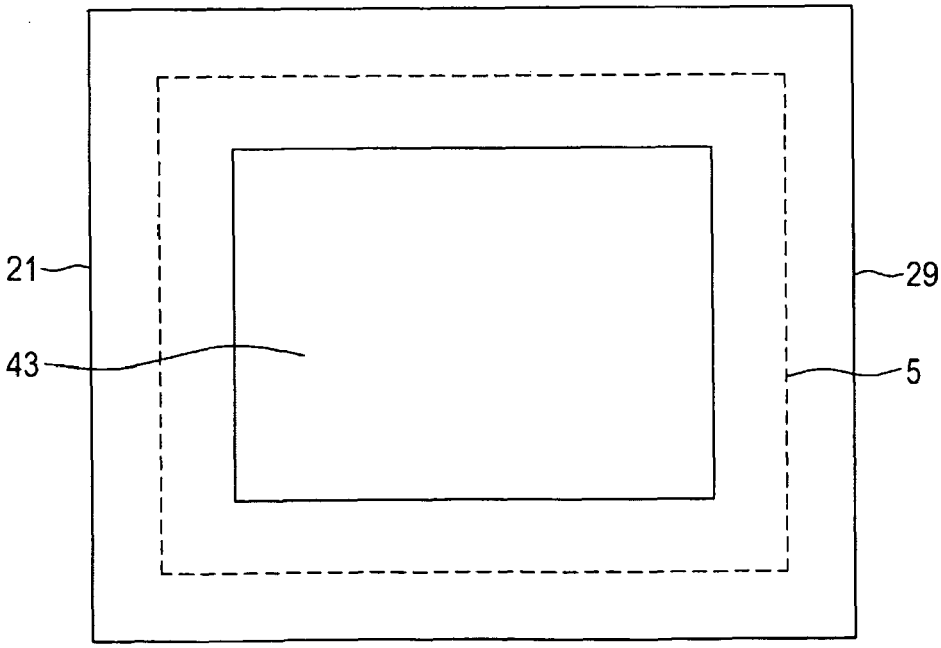
FIG. 2 is a bottom view of the embodiment of FIG. 1 installed in an attic opening in a building.

FIG. 1 schematically illustrates a sectional side view of an embodiment of an attic access apparatus 1 of the present invention. FIG. 2 illustrates a bottom view of the apparatus 1 when installed in an attic opening 5 that is framed into a building ceiling. The opening 5 is framed by structural members 7, typically rafters, planks, or the like. The final finish covering of the ceiling in FIG. 1 is drywall board 9 that is fastened to the structural members 7 by drywall screws 11. As is conventional, the heads of the drywall screws 11 are countersunk below the surface of the drywall board 9.

The attic access apparatus 1 comprises an access frame 21 with sidewalls 23 configured to extend upward into the attic opening 5 such that the outer surfaces of the sidewalls 23 fit in close proximity to the structural members 7 forming the opening 5 and can thus be conveniently fastened to these members 7 with fastening screws 25. A recessed groove 27 is provided along the inner surfaces of the sidewalls 23. The fastening screws 25 are located in the groove 27 so that the heads of the screws 25 are in the groove 27 and do not extend out from the inner surface of the sidewalls 23.

The sidewalls 23 extend upward from a middle portion of a flange member 29. The portion of the flange member 29 extending outward from the outer surfaces of the sidewall form a trim flange 31 configured to cover the drywall screws 11 used to fasten the surrounding drywall boards 9 to the bottom of the structural members 7 forming the attic opening 5. The portion of the flange member 29 extending inward from the inner surface of the sidewall forms a support flange 33. An insulated lid 35 is configured to drop into the opening 37 formed by the inner surfaces of the sidewalls 23 and rests on the support flange 33.

A seal 39 is provided on the top surface of the support flange 33 to seal the lid 35 and frame 21 and prevent air movement through the attic access apparatus 1. A lip 41 on the top edge of the lid 35 also extends over the top edges of the sidewalls 23 as illustrated, and the lid 35 is configured so the lip is in close proximity to, or resting on, the top edge of the sidewalls 23 when the bottom of the lid 35 is resting on the support flange 33. A further seal can be provided on the top edge of the sidewall 23 or under the lip to further seal the apparatus.

As seen from the bottom view of FIG. 2, the bottom surface and edges of the flange member 29 are configured to provide a finished trim, such that the access frame 21 can simply be inserted and fastened, and the opening 5 to the attic is finished and ready for occupancy. Conveniently the frame 21 is constructed by extruding a plastic piece that includes the grooved sidewalls and flange member, and then the extrusion is simply cut and welded to form the access frame 21. The "T" shape of the extrusion, in addition to providing the necessary walls, grooves, and flanges as described above, also adds rigidity to the extrusion, and to the frame 21 once formed, and thus makes the frame relatively convenient to install.

The bottom surface and exposed edges of the flange member 29 are rounded and smoothed and colored as desired to provide the desired finished appearance. Similarly the bottom surface of the lid is provided by a prefinished panel 43 of the desired color. The flange member 29 and bottom surface of the lid 35 are thus prefinished to provide an acceptable appearance for a finished ceiling.

The lid 35 is conveniently formed by shaping a thick piece of foam insulation, or by gluing a larger upper sheet of foam A to a smaller lower sheet of foam B to form the lip 41, and then gluing the prefinished panel 43 to the bottom exposed surface of the lower sheet B. The lip 41 includes a significant thickness of insulation above the lip 41, and the lid 35 is configured such that the outer edge of the lip 41 in proximity to the structural members 7 that form the attic opening 5, such that the framed attic opening 5 is substantially filled with foam insulation to reduce heat loss or gain through the apparatus 1. A gap 45 is provided between the edge of the lip 41 and the structural members 7 in order to facilitate opening and closing the lid 35.

It is contemplated that the most common color for the bottom of the lid 35 and flange member 29 will be some shade of white however other colors may also prove to be popular.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An attic access apparatus to provide access to an attic through an attic opening in a ceiling, the apparatus comprising:

an access frame with sidewalls extending upward from a middle portion of a flange member to define an access opening, the sidewalls configured to extend upward into the attic opening between structural members forming the attic opening such that outer surfaces of the sidewalls of the access frame fit in close proximity to the structural members;

a recessed groove along inner surfaces of the sidewalls configured such that fastening screws can be located in the groove so that heads of the screws are in the groove and below inner surfaces of the sidewalls of the access frame;

wherein an outward portion of the flange member extends outward from outer surfaces of the sidewall to form a trim flange configured to cover fasteners used to fasten the ceiling to the bottom of the structural members;

wherein an inward portion of the flange member extends inward from the inner surfaces of the sidewalls to form a support flange;

an insulated lid configured to drop into the access opening formed by the inner surfaces of the sidewalls and rest on the support flange; and a seal member operative to provide a seal between the lid and the access frame to prevent air movement between the lid and access frame;

wherein a lip on an upper edge of the lid extends over top edges of the sidewalls, and the lid is configured so the lip is in close proximity to, or resting on, the top edge of the sidewalls when the bottom of the lid is resting on the support flange.

2. The apparatus of claim 1 wherein the seal member is provided on a top surface of the support flange.

3. The apparatus of claim 1 comprising a lip seal member operative to seal a bottom side of the lip to the top edge of the sidewall.

4. The apparatus of claim 1 comprising an insulated sheet covering a top of the lid above the lip such that edges of the insulated sheet are in proximity to the structural members.

5. The apparatus of claim 1 wherein a bottom of the lid and a bottom of the flange member are prefinished to provide an acceptable appearance for a finished ceiling.

6. The apparatus of claim 1 wherein the access frame is made by extruding a T-shaped plastic member with the sidewall extending upward from the middle of the flange member, and the sidewall defining the groove, and cutting and welding the T-shaped member to form the access frame.

7. A method for providing access to an attic through an attic opening in a ceiling, the method comprising:

forming an access frame from T-shaped members having a wall extending upward from a middle portion of a flange member, the access frame having sidewalls extending upward from the flange member, the access frame defining an access opening;

configuring the access frame such that the sidewalls extend upward into the attic opening between structural members forming the attic opening such that outer surfaces of the sidewalls of the access frame fit in close proximity to the structural member, and such that an outward portion of the flange member extends outward from outer surfaces of the sidewall to form a trim flange configured to cover fasteners used to fasten the ceiling to the bottom of the structural members, and such that an inward portion of the flange member extends inward from the inner surfaces of the sidewalls to form a support flange;

providing a recessed groove along inner surfaces of the sidewalls, and driving fasteners through the sidewalls into the structural members such that heads of the fasteners are located in the groove below inner surfaces of the sidewalls of the access frame;

providing an insulated lid and dropping the lid into the access opening from above the access frame down into the access opening such that a bottom surface of the lid rests on the support flange; and providing a seal between the lid and the access frame to prevent air movement between the lid and access frame;

wherein a lip on an upper edge of the lid extends over top edges of the sidewalls, and the lid is configured so the lip is in close proximity to, or resting on, the top edge of the sidewalls when the bottom of the lid is resting on the support flange.

8. The method of claim 7 wherein the seal is provided on a top surface of the support flange.

9. The method of claim 7 comprising providing a seal operative to seal a bottom side of the lip to the top edge of the sidewall.

10. The method of claim 7 comprising forming the lid by one of (a) shaping a piece of foam insulation such that a larger upper portion forms the lip and such that a smaller lower portion extends downward between the sidewalls, and (b) gluing a larger upper sheet of insulation to a smaller lower sheet of insulation.

11. The method of claim 10 comprising gluing a prefinished panel to a bottom exposed surface of the lid.

12. The method of claim 7 wherein a bottom of the lid and a bottom of the flange member are prefinished to provide an acceptable appearance for a finished ceiling.

13. The method of claim 7 comprising extruding the T-shaped member from plastic, and forming the access frame by cutting and welding the T-shaped member to form the access frame.

* * * * *